US006119753A

United States Patent [19]

Begemann et al.

[11] Patent Number: 6,119,753

[45] Date of Patent: Sep. 19, 2000

[54] DEVICE FOR LAYING END PAPERS ON INNER BOOKS

[75] Inventors: Kurt Begemann, Lohne; Hans-Hermann zur Heide, Rahden, both of Germany

[73] Assignee: Kolbus GmbH & Co. KG, Rahden, Germany

[21] Appl. No.: 08/883,886

[22] Filed: Jun. 27, 1997

[30] Foreign Application Priority Data

Jul. 13, 1996 [DE] Germany ..... 196 28 308

[51] Int. Cl.[7] ..... B42C 9/00

[52] U.S. Cl. ..... 156/566; 156/556; 156/559; 156/570; 412/4; 412/19; 412/37

[58] Field of Search ..... 156/556, 559, 156/561, 566, 563, 570; 412/4, 19, 24, 37

[56] References Cited

U.S. PATENT DOCUMENTS 4,491,448 1/1985 Anders et al. ..... 412/21

5,108,244 4/1992 Bellanca ..... 412/37

FOREIGN PATENT DOCUMENTS 19 38 121 11/1964 Germany .

29 48 802 6/1981 Germany .

37 13 036 4/1987 Germany .

*Primary Examiner*—Richard Crispino

*Assistant Examiner*—Sue A. Purvis

*Attorney, Agent, or Firm*—Alix, Yale & Ristas, LLP

[57] ABSTRACT

Apparatus for applying end papers to the front and rear sides of inner books which are continuously moving along a transport path includes end paper channels extending along the transport path and feeders for isolating individual end papers from stacks and delivering the end papers into the channels for simultaneous conveyance with the inner book. The feeders position the end papers such that they are oriented substantially parallel with the sides of the inner book while delivering the end papers into the channels in the direction of inner book movement. The moving end papers are overtaken by the mechanisms which impart movement to the books and the simultaneous moving end papers and inner books are subsequently pressed together to bond the end papers to the inner book.

23 Claims, 3 Drawing Sheets

DEVICE FOR LAYING END PAPERS ON INNER BOOKS

BACKGROUND OF THE INVENTION

1. Field of the Invention

This invention relates to the "laying" of end papers on the front and rear sides of inner books and, particularly, to the application of end papers to book blocks which are being continuously conveyed, with their spine sides facing downwardly, along a transport path. More specifically, the present invention is directed to apparatus for delivering end papers into registration with moving book blocks and, especially, to such apparatus having end paper guide channels extending along an inner book transport path and further having feeders for isolating end papers from stacks and delivering the thus isolated end papers into the guide channels such that, while moving parallel to the transport path, they are overtaken by the inner book to which they are to be applied. Accordingly, the general objects of the present invention are to provide novel and improved methods and apparatus of such character.

2. Description of the Prior Art

In the book binding art, and particularly in the manufacture of hard cover books, end papers are applied to the opposite sides of the "inner" books, i.e., bound book blocks which have been previously formed. These end papers are in the form of folded sheets which are adhesively bonded to the outermost sheets of the inner books.

Published German Patent Application 29 48 802 discloses a device for applying end papers to the first and last folded sheets of an inner book located in a transport channel of an adhesive binding machine. In this prior art apparatus, the end papers are isolated from a stack, by means of laterally positioned rotating feeders associated with a magazine and cooperating draw-off drums with grippers, and are fed to U-shaped channels arranged at a distance from the transport channel. The inner book and the end papers are subsequently simultaneously transported, respectively in the inner book channel and in the end paper channels, via fingers which are carried by a drive chain. The end papers are secured to the first and last sheets of the inner book, by means of an adhesive, in such a manner that a space or interval is usually provided between first edges of the end papers and the parallel edges of the inner book spine region. This interval is a function of the particular binding process being employed and is achieved by vertically offsetting the bases of the end paper channels relative to the base of the inner book transport channel.

A significant problem incident to the use of prior art devices of the type depicted in the above-referenced application is warping or buckling of the end papers. This warping or buckling results from the fact that the end papers will be at rest in their channels when contacted by the continuously moving fingers of the transport, i.e., the buckling or warping occurs as a consequence of the impact of the transport fingers on the trailing edges of the end papers.

A further deficiency of the above-described and other prior art apparatus resides in the fact that book through-put speed is limited by the time interval required to place new end papers in the channels after movement has been imparted to immediately preceding end papers. As should be obvious, new end papers cannot be delivered to the end paper channels until the previously delivered papers have been placed into motion and transported a distance greater than their width.

Machinery used in the manufacture of books must have sufficient flexibility so as to able to be adjusted to process books having different formats. The relatively large diameter of the draw-off drums required for end papers of books having a large format, in conjunction with the disposition of the rotating feeders and the end paper supply magazine above the end paper channels, inherently results in a relatively large dropping height for the end papers when books having a relatively small format are produced using the same equipment. This, in turn, leads to an essentially unchecked throwing of the small-format book end papers into the end paper channels, with concomitant misfeeds, as well as ergonomically unfavorable working conditions when laying the stack of end papers in the magazine.

SUMMARY OF THE INVENTION

The present invention provides novel and improved apparatus for applying end papers to the front and rear sides of inner books in a manner which overcomes the above-discussed, and other, deficiencies and disadvantages of the prior art. The invention thus consists of an apparatus, and a method which is implemented thereby, which permits a substantial increase in performance and, particularly, enhancements in functional reliability.

In accordance with the present invention, end papers are extracted from magazines and delivered to end paper channels in the direction of conveyance of the inner books, i.e., once the end papers are set into motion, they will continuously travel generally in the direction of motion of the continuously moving inner books. The operation of the feeders for the end papers is synchronized with the movement of the inner books such that the mechanical members which propel the inner books along the transport path will overtake moving end papers thereby avoiding potentially damaging impacts on the edges of the end papers.

Apparatus in accordance with the invention includes end-paper feeders having magazines for receiving horizontally oriented stacks of end papers. The feeders isolate individual end papers from a stack and impart movement thereto in the direction of conveyance of the inner book. During movement under the influence of the feeders, the extracted individual end papers will be turned from their initial horizontal orientation into a substantially vertical orientation. Accordingly, prior to the adhesive bonding of the end papers to the inner book, the end papers will be brought into proper registration with the inner book. Such proper registration will include the requisite space or interval at the edge of each end paper which faces a spine edge of the inner book. The feeders also insure that the end papers will be travelling in the same direction as the continuously moving inner books prior to acquisition by the inner book transport mechanism.

Thus, in accordance with the present invention, end papers are fed to the end paper channels of an adhesive binding machine in the direction of conveyance of the inner books in such a manner that the transport of the end papers will be taken over by the inner book transporters during movement of the end papers and without requiring a change in the direction of motion of the end papers.

BRIEF DESCRIPTION OF THE DRAWING

The present invention may be better understood, and its numerous objects and advantages will become apparent to those skilled in the art, by reference to the accompanying drawing wherein like reference numerals refer to like elements in the several Figures and in which.

DESCRIPTION OF THE DISCLOSED EMBODIMENT

Figure 1:
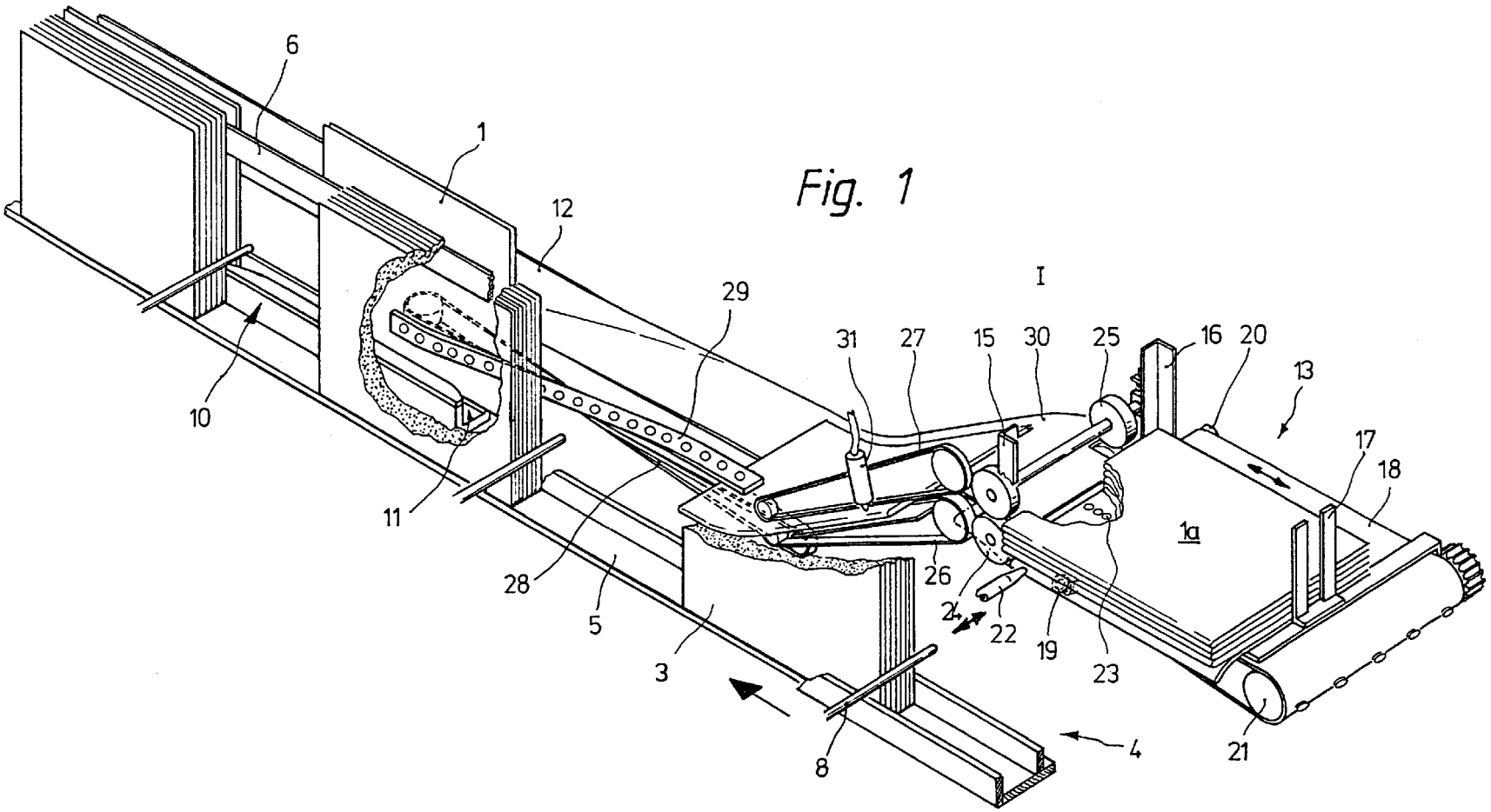
FIG. 1 is a partial perspective view of an apparatus for laying end papers on an inner book in accordance with the invention, FIG. 1 depicting the application of an end paper to a single side only of an inner book.

With reference to the Figures, inner books which are to have end papers adhesively bonded thereto are indicated at 3. The inner books 3, i.e., previously formed book blocks, are shown as moving continuously along a linear transport path defined by an inner book channel 4. The inner books 3, with their back or spine sides resting against the base 5 of channel 4, are propelled along the channel by means of transporters 8 which, in the disclosed embodiment, constitute fingers or push rods which extend from a drive chain, indicated schematically at 9 in FIG. 2, which is continuously circulating. During transport along channel 4, the vertical orientation of the inner books 3 is maintained by the side walls of channel 4 and by upper lateral guides 6 which are located so as to be substantially parallel with the channel side walls.

Figure 2:
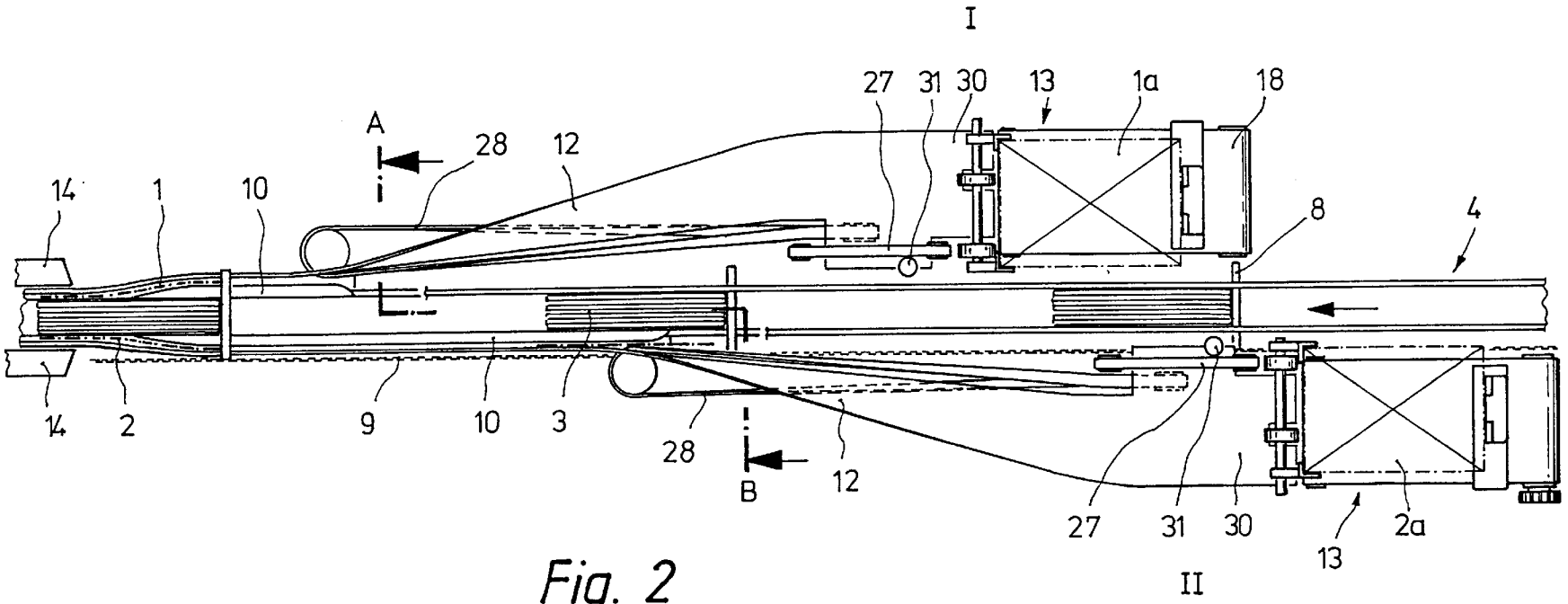
FIG. 2 is a schematic, top plan view of apparatus in accordance with the invention, the FIG. 2 apparatus applying end papers to both sides of a moving inner book.
Figure 3:
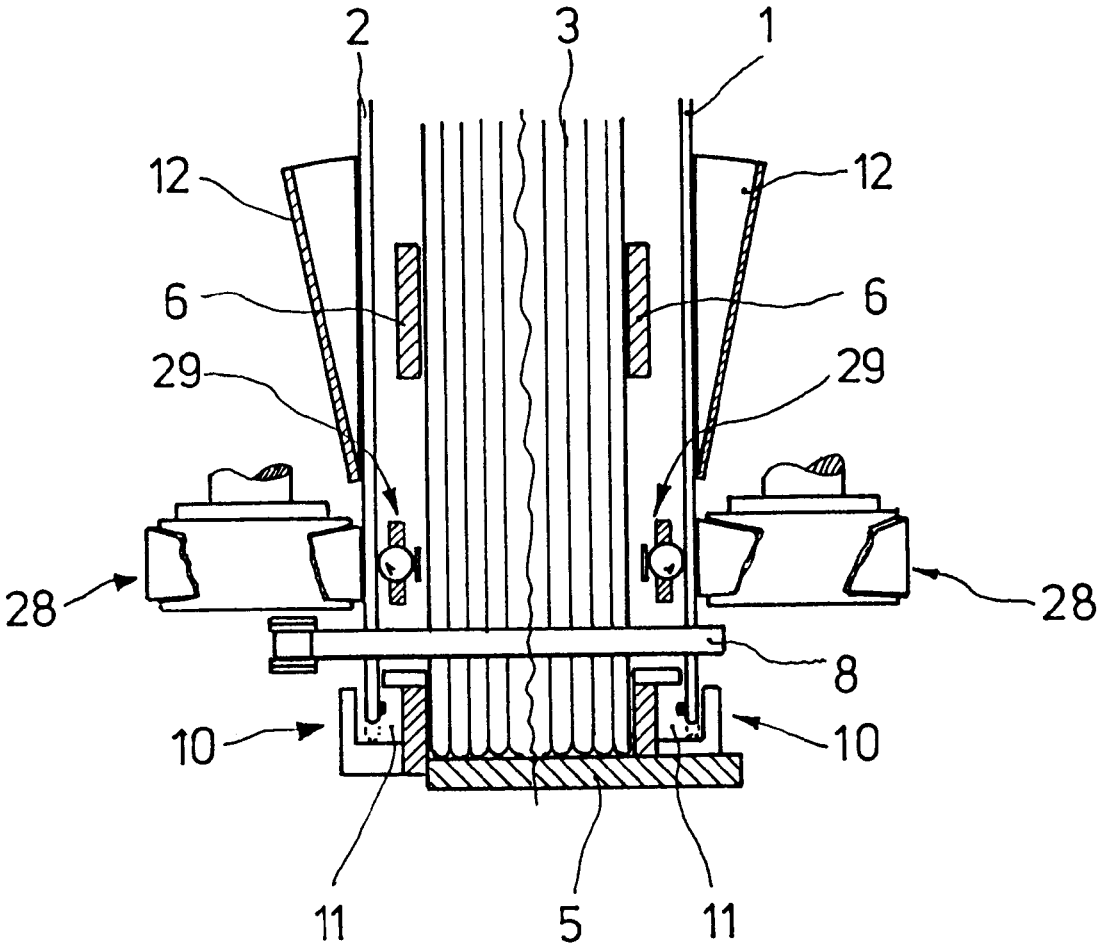
FIG. 3 is a cross-sectional side elevation view taken along line A–B of FIG. 2.

End paper channels, indicated generally at 10 in FIG. 3 and also shown in FIG. 2, extend along a portion of inner book channel 4 on both sides thereof. The end papers, indicated at 1 and 2, are fed from respective end paper stacks 1*a* and 2*a* into the parallel end paper channels 10. The feeder systems for the end papers are indicated generally at I and II and, in the embodiment of FIG. 2, are disposed on opposite sides of inner book channel 4. The apparatus of the invention also includes, as can be seen from all of the Figures., upper end papers guides 12. In the manner to be described below, the end papers 1, 2 will be manipulated such that, when they reach the downstream or discharge ends of the feeder systems I and II, they will be transposed from their initial horizontal orientation to a substantially vertical orientation. This transposition occurs while the end papers move along, and are thus partly supported by, upper guides 12 and is substantially completed before the trailing edges of the moving end papers are contacted by transporters 8.

As depicted in FIG. 2, the end paper feeder systems I and II may be offset from one another, along the inner book transport path, in order to facilitate placement of the stacks 1*a* and 2*a* in the feeder systems from the same side of the apparatus. When such an offset is employed, the transporters 8 will acquire the oppositely situated end papers serially.

As best seen from FIG. 3, the end paper channels 10 are, in part, defined by structural members which are integral with the inner book transport channel 4. Also, as believed best seen from FIG. 1, at least at the downstream ends of the feeder systems, the lateral inner book guides 6 may also function as supports for the end papers during their forward transport.

Referring to FIG. 2, the U-shaped end paper channels 10 open into, i.e., converge with, the inner book channel 4 at their downstream ends. Likewise, the lateral upper supports 6 and guides 12 converge and terminate immediately upstream of a pair of oppositely disposed pressing rails 14. The end papers 1, 2, which will be provided with strip-shaped coatings of adhesive in the manner to be described below, are thus guided into abutment with respective sides of the inner book and are subsequently bonded to the inner book by the pressing rails 14.

The bottoms of end paper channels 10 are vertically offset relative to the bottom of inner book transport channel 4. The amount of this vertical offset may be adjusted by means which have been omitted from the drawing in the interest of facilitating understanding of the invention. It should be appreciated, therefore, that the embodiment of the invention being described has been illustrated schematically. The size of the vertical offset will be determined by the particular binding process, as noted above, and will result in adherence of the end papers to the sides of the inner book with first, i.e., lower, edges of the end papers being displaced above, and generally parallel with, the support plane for the inner book as defined by base 5 of channel 4.

In accordance with the invention, end papers 1, 2 are delivered to end paper channels 10 in the direction of conveyance of the inner books 3. Individual end papers, when isolated and extracted from a stack, are caused to move continuously and a component of this motion is always parallel to the transport path of the inner books during the infeed operation. Accordingly, the inner book transporters 8 overtake end papers which are oriented generally parallelly with respect to the sides of the inner book and which are moving in the same direction as the inner book.

The end paper feeder systems I and II include magazines, indicated generally at 13, which receive and support the stacks 1*a*, 2*a* of horizontally oriented end papers with the folded edges thereof facing the central vertical plane of the inner book transport path. The magazines 13, as best seen from FIG. 1, include abutment angle members 15, 16 at the forward, i.e., discharge, ends thereof. Magazines 13 also have rear stops 17 and perforated movable belts 18 which define the floors of the magazines. The width of belts 18, as may be seen from FIGS. 2 and 3, is less than the width of the magazines. Accordingly, in edge regions thereof which face the inner book transport path, the stacks of end papers are not supported. The purpose of these unsupported edge regions is to permit the engagement, and subsequent isolation from the stack, of the lowermost end paper. To this end, separator means including an intermittently operated gripping device, in the form of a suction apparatus 19, is provided. The suction apparatus 19 is positioned so as to cooperate with the lowermost end paper in a stack adjacent its unsupported, i.e., inner book facing, edge. The belt 18 also forms part of the separation means and is provided with a non-slip surface. Belt 18 is supported on guide rollers 20, 21, the belt being fastened to roller 21. Motion imparted to driven guide roller 21, by means not shown, will cause belt 18 to move forwardly and backwardly, i.e., in the downstream and upstream directions.

As clearly shown in FIG. 1, in order to separate an end paper from the bottom of a stack in a magazine 13, the suction apparatus 19 is activated and the end paper is "gripped" in the unsupported edge region thereof and "tipped-off" the stack. The suction apparatus 19 is actuated, i.e., coupled to a low pressure source, in synchronism with the movement of belt 18 which, in turn, is synchronized with the inner book transport. When the edge region of an end paper has been deflected as shown in FIG. 1, pressurized air is delivered to a nozzle 22 located adjacent the stack in the magazine. The air discharged from nozzle 22 will "separate" the lowermost end paper from the stack, i.e., an air cushion is established which reduces friction between the lowermost end paper and the adjacent, immediately above, end paper in the stack. If necessary or desirable, the nozzle 22 can be moved, by drive means not shown, toward and away from the side of the stack so as to physically support, in the edge region where the gripping device operates, the stack of end papers disposed above the lowermost end paper. Any such movement of nozzle 22 will, of course, be synchronized with the motion of belt 18 and the operation of suction apparatus 19. Movement of nozzle 22 into vertical registration with the stack will, in addition to physically supporting the edge of the stack above the deflected bottom sheet, efficiently deliver the pressurized air to the upper "glide plane" of the end paper being withdrawn from the stack.

In order to facilitate end paper extraction from the stack in a magazine 13, belt 18 is provided with perforations 23 which, with the belt in its most upstream position, extend from the vicinity of guide roller 20 as shown in FIG. 1. Belt 18 may thus function as a vacuum conveyor, i.e., the perforations 23 are, in synchronism with the belt movement, coupled to a low pressure source. Thus, belt 18 engages the lowermost end paper in the stack and delivers the thus engaged end paper in the downstream direction to the point where the end paper is acquired by a draw-off mechanism. This draw-off mechanism includes driven rollers 24 and resiliently supported counter-pressure rollers 25. The rollers 24 are driven constantly at high speed. The belt 18 delivers the leading, i.e., downstream, edge of an extracted end paper into the nip of rollers 24 and 25.

After an end paper has been acquired by the draw-off mechanism comprising rollers 24 and 25, the direction of movement of belt 18 will be reversed and the belt will be moved back to its most upstream starting position for the purpose of engaging and forward feeding the next end paper. Return of belt 18 to its starting position is permitted by maintenance of the air flow from nozzle 22 and by causing reversal of the direction of flow through the perforations 23 in belt 18 itself. In other words, the movement of belt 18 in the backwards or upstream direction is permitted by the creation of an air cushion between belt 18 and the bottom of the stack of end papers. Accordingly, the backward movement of belt 18 will not be accompanied by sufficient friction on the lowermost end paper remaining in the stack to cause any damage thereto and the rear stop 17 of the magazine will prevent undesired movement of the stack.

The cooperating rollers 24 and 25 drive an extracted end paper onto a first or delivery conveyor having cooperating lower and upper endless belts 26 and 27. Belts 26 and 27 are driven at the same speed as rollers 24 and grip an isolated end paper along an edge region thereof. The conveyor defined by endless belts 26 and 27 extends obliquely downwardly, relative to the plane defined by the base of magazine 13, and includes a support surface 30. This support surface, as will be described in more detail below, guides end paper movement from the draw-off mechanism to the discharge end of the apparatus. The delivery conveyor comprising belts 26 and 27 feeds a second or clamping conveyor which is comprised of a further endless conveyor belt 28 and a cooperating counter-pressure means. In the disclosed embodiment, as may be seen by joint consideration of FIGS. 1 and 3, the mechanism for applying counter-pressure to an end paper being moved by belt 28 comprises a ball rail 29.

The end paper support surface 30 merges, in the area of the clamping conveyor, into the upper end paper guide 12. The conveyor belt 28 and the ball rail 29 of the clamping conveyor twist about their longitudinal central axes and the end paper support surface, as defined by the upper guide 12, undergoes a similar twist. The belt 28 is driven at the speed of the delivery conveyor and, as an end paper moves under the influence of belt 28 while being guided by ball rail 29 and upper guide 12, the end paper will be rotated through an angle of 90°. Thus, while moving in the downstream direction, the orientation of an end paper will be transposed from horizontal, as the paper leaves magazine 13, to vertical at the downstream end of the clamping conveyor. When an end paper is released by the clamping conveyor into an end paper channel 10, for entrainment by a transporter 8, its folded edge will be against or in close proximity to the base of the end paper channel.

Means for applying a strip of an adhesive to the moving end papers are provided in the regions of the delivery conveyors. As shown in FIGS. 1 and 2, the adhesive applicators may be in the form of nozzles 31 which have their discharge ends located on the inner book transport path sides of the upper belts 27 of the delivery conveyors. The nozzles 31 will lay an adhesive stripe on the end papers at a defined distance from, and parallel to, the folded edge thereof.

In the interest of avoiding the fouling thereof with adhesive, the end paper channels 10 are, as best seen from FIG. 3, each provided with a side wall groove or recess 11 The spaces defined by the recesses are located so as to encompass the stripes of adhesive laid down by nozzles 31 on the end papers.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. Apparatus for applying end papers to the oppositely disposed sides of an inner book which is moving continuously along a transport path under the influence of a transport member, said apparatus comprising:

a pair of end paper channels, said end paper channels extending along at least a portion of the transport path and having discharge ends which are in communication with the transport path, the transport members extending into registration with the discharge ends of the end paper channels; and feeders for delivering end papers into respective of said channels, said feeders each including:

a stacked supply of end papers;

a separator for extracting individual end papers from said stacked supply; and delivery means for delivering said extracted end papers into said channels with a component of motion which is directed parallel to said transport path whereby end papers individually delivered into respective of said channels will be overtaken while in a movement phase by a transport member which is moving an inner book to which said delivered end papers are to be applied.

2. The apparatus of claim 1 wherein said stacked supply of end papers each comprises a magazine for receiving horizontally stacked end papers, and wherein said delivery means each comprises a first conveyor for transferring extracted end papers from a horizontal orientation into a substantially vertical orientation during the said motion thereof parallel to said transport path.

3. The apparatus of claim 2 wherein said first conveyor comprises an endless belt which frictionally engages a first side of an end paper, said first conveyor further comprising a counter-pressure member which cooperates with said belt, said counter-pressure member contacting the second side of said engaged end paper, said counter-pressure member permitting substantially unimpeded motion of the end paper with said belt.

4. The apparatus of claim 3 wherein said counter-pressure member comprises a ball rail.

5. The apparatus of claim 3 wherein said delivery means each further comprises:

a support surface which extends generally parallel to a path of end paper movement defined by said delivery means.

6. The apparatus of claim 3, wherein said feeders are offset in relation to one another along said transport path.

7. The apparatus of claim 6 wherein said delivery means each further comprises:

a second end paper conveyor, said second conveyor being located upstream in the direction of end paper motion from said first conveyor, said second conveyor transporting extracted end papers in a flat condition; and an adhesive applicator for applying a strip of adhesive to end papers travelling on said second conveyor.

8. The apparatus of claim 7 wherein said delivery means each further comprises:

a support surface which extends generally parallel to a path of end paper movement defined by said delivery means.

9. The apparatus of claim 2 wherein said delivery means each further comprises:

a support surface which extends generally parallel to a path of end paper movement defined by said delivery means.

10. The apparatus of claim 2 wherein said delivery means each further comprises:

a second end paper conveyor, said second conveyor being located upstream in the direction of end paper motion from said first conveyor, said second conveyor transporting extracted end papers in a flat condition; and an adhesive applicator for applying a strip of adhesive to end papers travelling on said second conveyor.

11. The apparatus of claim 10, wherein said adhesive applicator comprises a nozzle through which a strip of adhesive is discharged onto moving end papers.

12. The apparatus of claim 10 wherein said delivery means each further comprises:

a support surface which extends generally parallel to a path of end paper movement defined by said delivery means.

13. The apparatus of claim 12, wherein said adhesive applicator comprises a nozzle through which a strip of adhesive is discharged onto moving end papers.

14. The apparatus of claim 13, wherein said end paper channels each include a recessed side wall portion which faces outwardly with respect to said inner book transport path.

15. The apparatus of claim 14, wherein said nozzles are positioned such that said strip of adhesive will be registered with said end paper channel recessed side wall portions when said end papers have been reoriented into the substantially vertical position.

16. The apparatus of claim 2, wherein said end paper channels each include a recessed side wall portion which faces outwardly with respect to said inner book transport path.

17. The apparatus of claim 16 wherein said delivery means each further comprises:

a second end paper conveyor, said second conveyor being located upstream in the direction of end paper motion from said first conveyor, said second conveyor transporting extracted end papers in a flat condition; and an adhesive applicator for applying a strip of adhesive to end papers travelling on said second conveyor.

18. The apparatus of claim 17, wherein said adhesive applicator comprises a nozzle through which a strip of adhesive is discharged onto moving end papers.

19. The apparatus of claim 18, wherein said nozzles are positioned such that said strip of adhesive will be registered with said end paper channel recessed side wall portions when said end papers have been reoriented into the substantially vertical position.

20. The apparatus of claim 19 wherein said first conveyor comprises an endless belt which frictionally engages a first side of an end paper, said first conveyor further comprising a counter-pressure member which cooperates with said belt, said counter-pressure member contacting the second side of said engaged end paper, said counter-pressure member permitting substantially unimpeded motion of the end paper with said belt.

21. The apparatus of claim 20 wherein said counter-pressure member comprises a ball rail.

22. The apparatus of claim 1, wherein said end paper channels each include a recessed side wall portion which faces outwardly with respect to said inner book transport path.

23. The apparatus of claim 1 wherein said feeders are offset in relation to one another along said transport path.

* * * * *